United States Patent [19]

Lyle

[11] Patent Number: 4,912,611

[45] Date of Patent: Mar. 27, 1990

[54] PURSE LIGHT

[76] Inventor: Archie A. Lyle, 4412 Dennis Dr., High Ridge, Mo. 63049

[21] Appl. No.: 341,957

[22] Filed: Apr. 24, 1989

[51] Int. Cl.[4] ..... A45C 15/06

[52] U.S. Cl. ..... 362/156; 362/155; 362/191

[58] Field of Search ..... 362/155, 156, 191, 202, 362/205, 253

[56] References Cited

U.S. PATENT DOCUMENTS

| | | | |
|---|---|---|---|
| 1,268,846 | 6/1918 | Holton | 362/155 |
| 2,218,396 | 10/1940 | Hallbauer | 362/156 |
| 2,304,387 | 12/1942 | Whiting et al. | 362/156 |
| 2,558,606 | 6/1951 | Crockett | 362/156 |
| 3,408,489 | 10/1968 | Boyer et al. | 362/156 |
| 3,609,341 | 9/1971 | Castaldo | 362/156 |
| 3,609,342 | 9/1971 | Wisniewski | 362/156 |
| 3,800,134 | 3/1974 | Castaldo | 362/155 |
| 3,976,871 | 8/1976 | Atherton | 362/156 |
| 4,654,763 | 3/1987 | Knight | 362/156 |

*Primary Examiner*—Stephen F. Husar

*Attorney, Agent, or Firm*—Andsel Group

[57] ABSTRACT

A handbag battery powered flashlight with a separate control switch that can be rapidly moved from handbag to handbag of either the rigid frame construction or the foldable fabric type. A control switch with actuating arms pressing against the sides of the handbag closing the switch contacts whenever the handbag is opened. Both the light source and the control switch having VELCRO, or similar material, for fastening to the interior surfaces of the handbag. A flexible electrical conductor connecting the light source to the control switch permits moving the light source to various locations for inspecting the external compartments of the handbag as well as illuminating the keyhole in a door or automobile ignition lock.

1 Claim, 1 Drawing Sheet

PURSE LIGHT

BACKGROUND OF THE INVENTION

1. Field of the Invention

The present invention relates to handbags having a movable light source for illuminating compartments inside and outside the handbag. Handbags of the type carried by ladies utilize different means for closure of the internal compartments; however, most all of the handbags use a folding of the two sides at the bottom or a rigid hinged closure, with clasping means at the top.

2. Description of the Related Art

A review of the prior art reveals many different methods for providing illumination means for the interior of handbags. The following U.S. Pat. Nos.: 2,218,396 Hallbauer, 3,408,489 Boyer et al, 2,558,606 Crockett, 3,960,342 Wishiewski, 3,976,871 Atherton, 2,304,387 Whiting et al, and 3,609,341 Castaldo all show light sources permanently fastened to the interior of a specific handbag. U.S. Pat. No. 4,654,763 Knight describes a pocketbook light that can be removably attached to the inside surface of a pocketbook or handbag. The prior art reviewed did not show a purse light capable of being removed from the purse attachment for illuminating the outside compartments of the purse as well as door key holes.

SUMMARY OF THE INVENTION

If it is the object of the present invention to provide a handbag or purse light source that can be quickly moved to other handbags or purses or to illuminate a door lock keyhole. The light source attachment to the interior surface of the handbag or purse is by VELCRO or other detachable fastening means. The control switch for the light source comprises a normally closed, single throw switch and enclosure actuated by spring arms normally restrained by the interior sides of the handbag or purse. The control switch enclosure assembly is installed in the bottom section of the purse or handbag, preferably at one end and secured by VELCRO or other fastening means. Opening the purse or handbag relieves the switch control arms to permit switch actuation.

The light source is a conventional "pen-light" flashlight with internal removable batteries and light bulb. The electrical circuit between the batteries and the light bulb is routed by means of a flexible electrical cable through the control switch.

In operation opening the handbag or purse closes the contacts in the control switch and illuminated the light source which then can be moved to illuminate the various interior and exterior compartments in the purse or handbag as well as to illuminate a door locking keyhole.

DETAILED DESCRIPTION OF THE PREFERRED EMBODIMENTS

Figure 1:
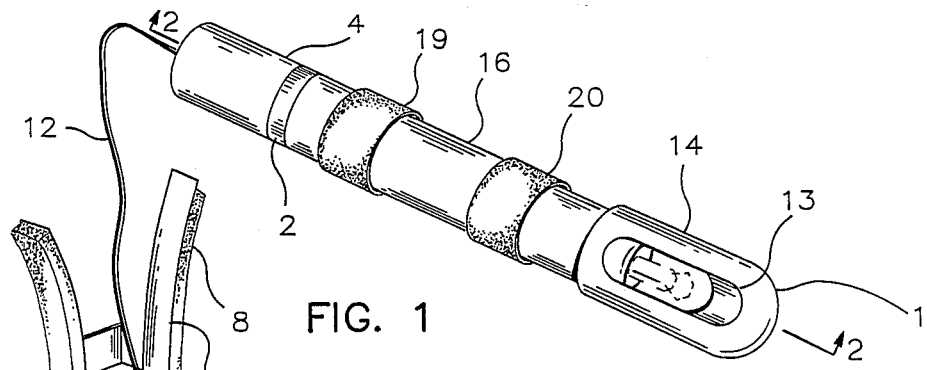
FIG. 1 is a perspective view of the light source and the control switch.

FIG. 1 shows the purse light assembly 1 with battery enclosure cap 4, finger grip 2, light bulb enclosure 14 with opening 13. Circumferential rings of VELCRO, or other fastening material 19 and 20 are shown on the exterior surface of the battery enclosure 16. The control switch 18 with connecting electric cable 12 is shown with the spring actuating arm 8 with VELCRO attaching means 21 and 22.

Figure 2:
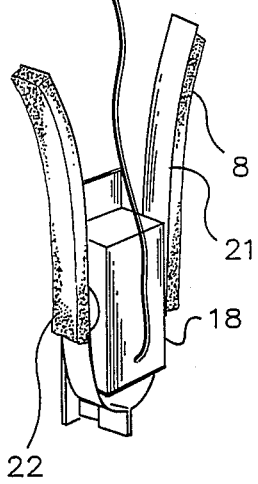
FIG. 2 is a partially sectioned side view of the control switch.
Figure 2:
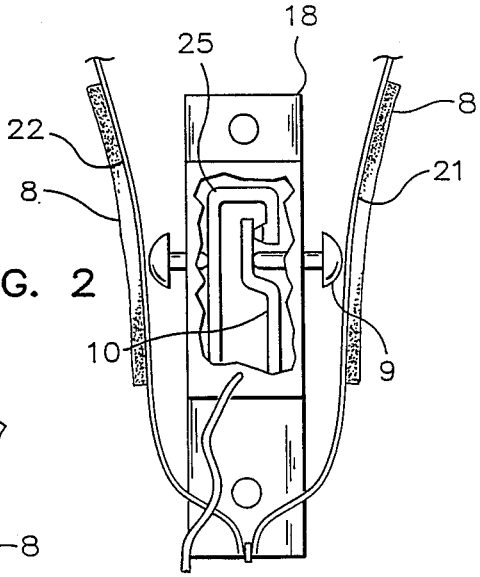

FIG. 2 is partially sectional side view of the control switch 18, contact supports 25, and 10 with actuating means 9 and flexible spring members 21 and 22. The outside surfaces of the spring members 21 and 22 have VELCRO coverings 8 for fastening the control switch within the purse or handbag.

Figure 3:
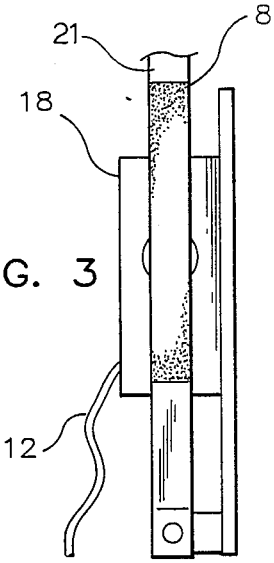
FIG. 3 is an end view of the control switch.

FIG. 3 is a front elevation of the control switch 18 with spring member 21 covered with VELCRO fastening material 8 and electric cable 12.

Figure 4:
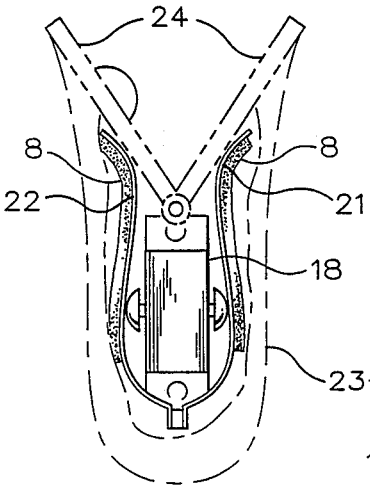
FIG. 4 is an end view of the control switch and light source installed in a handbag two pivoted sides and a top clasp.

FIG. 4 is a left end sectional view of the purse 23 and frame 24 showing the control switch 18 with spring members 21 and 20 covered with VELCRO fastening material 8.

Figure 5:
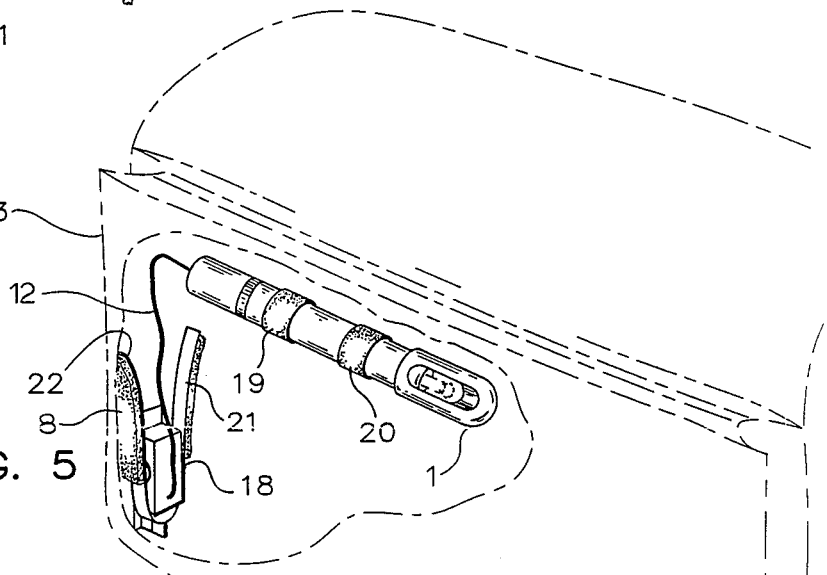
FIG. 5 is a perspective view of the light source and control switch installed in a flexible foldable type handbag.

FIG. 5 is a sectional side view of the purse 23 showing the purse light assembly secured to the interior purse wall with VELCRO rings 19 and 20. The control switch 18 secured to interior purse walls by VELCRO coverings 8 attached to spring members 21 and 22. The control switch electrically connected to the purse light assembly 1 by cable 12.

Figure 6:
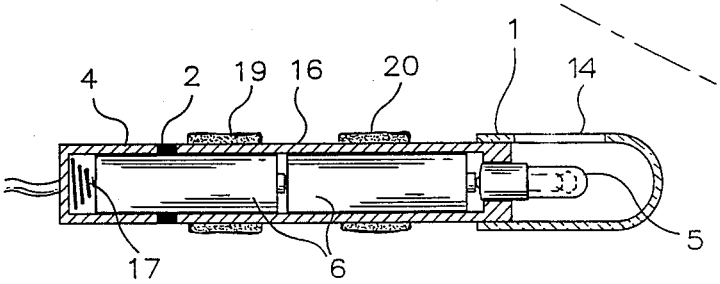
FIG. 6 is a sectional view through 2—2 of FIG. 1.

FIG. 6 is a sectional view through 2—2 of FIG. 1 showing the purse light assembly 7 with battery cap 4, insulating ring 2, battery spring 17, batteries 6, light bulb 5, the light bulb enclosure 14, the battery enclosure 16 and VELCRO rings 19 and 20.

I claim:

1. A handbag light source with a separate control switch that can be removably installed in any rigid frame foldable fabric type handbag wherein the improvement comprises:

(a), an illuminating device comprising an elongated cylindrical tubular casing containing a light bulb with associated batteries;

(b), the tubular casing having external circumferential rings of VELCRO or similar fastening means;

(c), means for replacing the batteries in the tubular casing;

(d), means for replacing the lightbulb in the tubular casing;

(e), a single pole single throw control switch having two actuator arms, one on each side of the switch;

(f), the actuator arms being spring biased to extend away from the switch;

(g), in the extended position the actuator arms positioning the switch contacts to the closed position;

(h), compressing the actuator arms to the switch housing positioning the switch contacts to the open position;

(i), the actuator arms capable of being formed on installation to conform with the inside surface of the handbag is opened;

(j), the surface of the actuating arms contacting the sides of the handbag covered with VELCRO or similar material; and, (k), a flexible electrical conductor connecting the control switch with the tubular light source.

* * * * *